US010748683B2

(12) United States Patent
Hidaka et al.

(10) Patent No.: US 10,748,683 B2
(45) Date of Patent: Aug. 18, 2020

(54) R-T-B BASED SINTERED MAGNET

(71) Applicant: TDK CORPORATION, Tokyo (JP)

(72) Inventors: Tetsuya Hidaka, Tokyo (JP); Takuma Hayakawa, Tokyo (JP); Makoto Iwasaki, Tokyo (JP); Ayato Kakoki, Tokyo (JP); Naoto Tsukamoto, Tokyo (JP); Fumitaka Baba, Tokyo (JP)

(73) Assignee: TDK CORPORATION, Tokyo (JP)

( * ) Notice: Subject to any disclaimer, the term of this patent is extended or adjusted under 35 U.S.C. 154(b) by 282 days.

(21) Appl. No.: 15/285,178

(22) Filed: Oct. 4, 2016

(65) Prior Publication Data

US 2017/0103835 A1 Apr. 13, 2017

(30) Foreign Application Priority Data

Oct. 7, 2015 (JP) ..... 2015-199500

(51) Int. Cl.

| | |
|---|---|
| ***H01F 41/02*** | (2006.01) |
| ***H01F 1/053*** | (2006.01) |
| ***H01F 1/057*** | (2006.01) |
| ***B22F 3/24*** | (2006.01) |
| ***C22C 38/12*** | (2006.01) |
| ***C22C 38/16*** | (2006.01) |
| ***C22C 33/02*** | (2006.01) |
| ***C22C 38/14*** | (2006.01) |

(Continued)

(52) U.S. Cl.

CPC ..... *H01F 1/0536* (2013.01); *C22C 28/00* (2013.01); *C22C 33/0278* (2013.01); *C22C 38/002* (2013.01); *C22C 38/005* (2013.01); *C22C 38/06* (2013.01); *C22C 38/10* (2013.01); *C22C 38/12* (2013.01); *C22C 38/14* (2013.01); *C22C 38/16* (2013.01); *H01F 1/0577* (2013.01); *H01F 41/0293* (2013.01); *C22C 2202/02* (2013.01)

(58) Field of Classification Search

None

See application file for complete search history.

(56) References Cited

U.S. PATENT DOCUMENTS

2008/0245442 A1 10/2008 Nakamura et al.
2009/0019969 A1* 1/2009 Kato ..... C22C 1/0441 75/228

(Continued)

FOREIGN PATENT DOCUMENTS

CN 101640087 A 2/2010
CN 102067249 A 5/2011

(Continued)

*Primary Examiner* — Xiaowei Su

(74) *Attorney, Agent, or Firm* — Oliff PLC

(57) ABSTRACT

An R-T-B based sintered magnet includes "R", "T", and "B". "R" represents a rare earth element including at least Tb. "T" represents a metal element except rare earth elements including at least Fe, Cu, Mn, Al, and Co. "B" represents boron or boron and carbon. With respect to 100 mass % of a total mass of the R-T-B based sintered magnet, a content of "R" is 28.0 to 32.0 mass %, a content of Cu is 0.04 to 0.50 mass %, a content of Mn is 0.02 to 0.10 mass %, a content of Al is 0.15 to 0.30 mass %, a content of Co is 0.50 to 3.0 mass %, and a content of "B" is 0.85 to 1.0 mass %. Tb2/Tb1 is 0.40 to less than 1.0, where Tb1 and Tb2 (mass %) denote a content of Tb at a surface portion and at a core portion, respectively.

13 Claims, 6 Drawing Sheets

(51) Int. Cl.

| | |
|---|---|
| ***C22C 38/00*** | (2006.01) |
| ***C22C 38/06*** | (2006.01) |
| ***C22C 38/10*** | (2006.01) |
| ***C22C 28/00*** | (2006.01) |

(56) References Cited

U.S. PATENT DOCUMENTS

| | | | | |
|---|---|---|---|---|
| 2010/0003156 | A1 | 1/2010 | Suzuki et al. | |
| 2011/0095855 | A1* | 4/2011 | Kuniyoshi | H01F 1/0577 335/302 |
| 2011/0150691 | A1 | 6/2011 | Nakamura et al. | |
| 2013/0293328 | A1* | 11/2013 | Kuniyoshi | B22F 3/24 335/302 |
| 2014/0062631 | A1* | 3/2014 | Sagawa | H01F 1/057 335/302 |
| 2014/0290803 | A1* | 10/2014 | Kato | H01F 1/0577 148/302 |
| 2015/0170810 | A1* | 6/2015 | Miwa | C22C 38/001 75/246 |

FOREIGN PATENT DOCUMENTS

| | | | | |
|---|---|---|---|---|
| WO | 2006/043348 | A1 | 4/2006 | |
| WO | WO-2013191276 | A1 * | 12/2013 | C22C 38/001 |

* cited by examiner

R-T-B BASED SINTERED MAGNET

BACKGROUND OF THE INVENTION

1. Field of the Invention

The present invention relates to an R-T-B based sintered magnet.

2. Description of the Related Art

Rare earth sintered magnets having an R-T-B based composition are a magnet having excellent magnetic properties and are under intensive investigations for further improvement of the magnetic properties thereof. In general, the residual magnetic flux density (residual magnetization) Br and the coercivity HcJ are used as a parameter to indicate the magnetic properties. Magnets having high values for these properties can be said to have excellent magnetic properties.

Patent Document 1 discloses a rare earth sintered magnet obtained by immersing a magnet body in a slurry prepared by dispersing a fine powder containing various kinds of rare earth elements in water or an organic solvent and then heating it to conduct the grain boundary diffusion.

Patent Document 1: WO 06/43348 A

SUMMARY OF THE INVENTION

An object of the present invention is to provide an R-T-B based sintered magnet having high residual magnetic flux density Br and coercivity HcJ and exhibiting excellent corrosion resistance and manufacturing stability.

In order to achieve the above object, the R-T-B based sintered magnet of the present invention includes "R", "T", and "B", wherein "R" represents a rare earth element including at least Tb, "T" represents a metal element other than rare earth elements including at least Fe, Cu, Mn, Al, and Co, "B" represents boron or boron and carbon, a content of "R" is 28.0 to 32.0 mass % with respect to 100 mass % of a total mass of the R-T-B based sintered magnet, a content of Cu is 0.04 to 0.50 mass % with respect to 100 mass % of a total mass of the R-T-B based sintered magnet, a content of Mn is 0.02 to 0.10 mass % with respect to 100 mass % of a total mass of the R-T-B based sintered magnet, a content of Al is 0.15 to 0.30 mass % with respect to 100 mass % of a total mass of the R-T-B based sintered magnet, a content of Co is 0.50 to 3.0 mass % with respect to 100 mass % of a total mass of the R-T-B based sintered magnet, and a content of "B" is 0.85 to 1.0 mass % with respect to 100 mass % of a total mass of the R-T-B based sintered magnet.

The R-T-B based sintered magnet of the present invention has the features described above, and thus can improve the residual magnetic flux density Br and the coercivity HcJ and obtain high corrosion resistance and manufacturing stability.

The R-T-B based sintered magnet of the present invention has a surface portion and a core portion, and a content of Tb at the surface portion is higher than a content of Tb at the core portion.

In the R-T-B based sintered magnet of the present invention, Tb2/Tb1 is 0.40 or more and less than 1.0, where Tb1 (mass %) denotes a content of Tb at the surface portion and Tb2 (mass %) denotes a content of Tb at the core portion.

In the R-T-B based sintered magnet of the present invention, "R" may include heavy rare earth elements consisting of substantially only Dy and Tb.

In the R-T-B based sintered magnet of the present invention, "R" may include a heavy rare earth element consisting of substantially only Tb.

In the R-T-B based sintered magnet of the present invention, it is preferable that "T" further includes Ga, and a content of Ga is 0.08 to 0.30 mass % with respect to 100 mass % of a total mass of the R-T-B based sintered magnet.

In the R-T-B based sintered magnet of the present invention, it is preferable that "T" further includes Zr, and a content of Zr is 0.10 to 0.25 mass % with respect to 100 mass % of a total mass of the R-T-B based sintered magnet.

In the R-T-B based sintered magnet of the present invention, it is preferable that "T" further includes Ga and Zr, a content of Ga is 0.08 to 0.30 mass % with respect to 100 mass % of a total mass of the R-T-B based sintered magnet, and a content of Zr is 0.10 to 0.25 mass % with respect to 100 mass % of a total mass of the R-T-B based sintered magnet.

In the R-T-B based sintered magnet of the present invention, it is preferable that Ga/Al is 1.30 or less by mass ratio.

DESCRIPTION OF THE PREFERRED EMBODIMENTS

Figure 1:
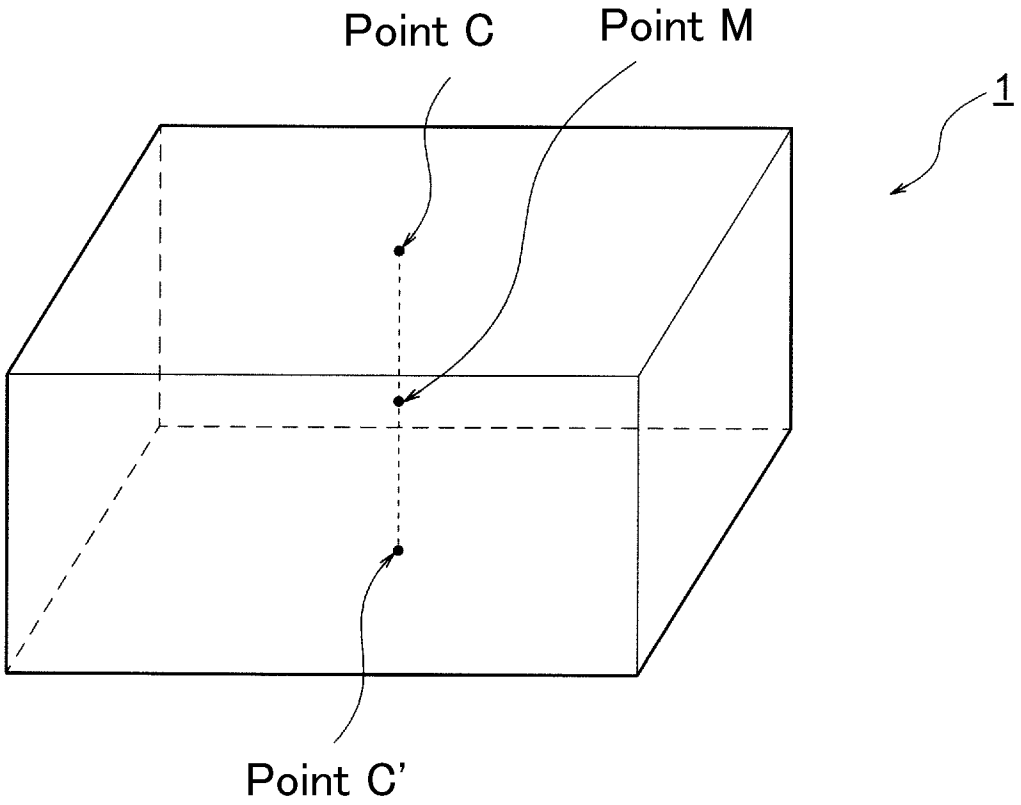
FIG. 1 is a schematic diagram of the R-T-B based sintered magnet according to the present embodiment.

Hereinafter, the present invention will be described with reference to embodiments illustrated in the drawings.

<R-T-B Based Sintered Magnet>

The R-T-B based sintered magnet according to the present embodiment has grains composed of $R_2T_{14}B$ crystals and grain boundaries.

The R-T-B based sintered magnet according to the present embodiment has any shape, such as a rectangular parallelepiped shape described in FIG. 1.

An R-T-B based sintered magnet 1 according to the present embodiment contains a plurality of specific elements including Tb in a specific range of contents. This makes it possible to improve the residual magnetic flux density Br, the coercivity HcJ, the corrosion resistance, and the manufacturing stability.

It is preferable that the R-T-B based sintered magnet 1 having a rectangular parallelepiped shape according to the present embodiment has a surface portion and a core portion, and the content of Tb at the surface portion is higher than the content of Tb at the core portion. This configuration makes it possible to improve the thermal demagnetization properties.

Hereinafter, the surface portion and the core portion in the present embodiment will be described.

The core portion in the present embodiment refers to a portion within 0.5 mm from a middle point of a straight line connecting between a central part on one surface and the center on the other surface facing the one surface.

In FIG. 1, for example, the core portion is a portion within 0.5 mm from a point M, where the point M is a middle point between a point C of a central part on one surface and a point C' on a central part on the other surface.

Hereinafter, the method for determining the point C and the point C' will be described. The centroid of one surface is denoted as the point C, and the centroid of the other surface facing to the one surface is denoted as the point C'. A point having the shortest distance from the centroid to the surface is denoted as the point C (point C') in a case in which the point C (point C') is not on the surface. In addition, the point C and the point C' are determined as follows in a case in which the point C (point C') is not on the surface and there are a plurality of points (hereinafter, also referred to as the point C") having the shortest distance from the centroid to the surface. First, the distance between the point C" and the ridge line including the surface having the point C" is denoted as W. It is possible to determine the minimum value of W (Wmin) and the maximum value of W (Wmax) for all of the points C". Here, the point having the largest Wmin among all of the points C" is adopted as the point C (point C'). In a case in which there are a plurality of points having the largest Wmin, the point having the smallest Wmax among the plurality of points is adopted as the point C (point C').

In addition, the surface portion is surfaces of each plane and a portion whose distance from the surfaces is 0.1 mm or less. When comparing with the content of Tb at the core portion, the content of Tb particularly on the surface having the largest area of the surface portion, specifically at 0.1 mm directly under the plane including the point C or the point C' is compared. Examples of the method for evaluating the Tb content include the LA-ICP-MS method mentioned below.

Furthermore, Tb2/Tb1 is preferably smaller and is specifically 0.40 or more and less than 1.0, where Tb1 (mass %) denotes the content of Tb at the surface portion, and Tb2 (mass %) denotes the content of Tb at the core portion. Tb2/Tb 1 is more preferably 0.40 or more and 0.9 or less, and is even more preferably 0.45 or more and 0.9 or less. This configuration makes it possible to improve the thermal demagnetization properties.

The method for generating the concentration distribution described above in the content of Tb is not particularly limited, but the concentration distribution in the content of Tb in the magnet bulk is preferably generated by the grain boundary diffusion of Tb mentioned below.

Incidentally, examples of the method for evaluating Tb1 and Tb2 of the Tb content include the LA-ICP-MS method. When evaluating Tb1 and Tb2 by this method, it is desirable to take the spot size by about 100 μm and to conduct the line analysis to be parallel to the surface. In this case, the average Tb amount can be evaluated without distinction between the main phase grains and the grain boundary phases.

"R" represents a rare earth element. The rare earth elements include Sc, Y, and lanthanide elements belonging to the third group in the long-form periodic table. The lanthanoid elements include, for example, La, Ce, Pr, Nd, Sm, Eu, Gd, Tb, Dy, Ho, Er, Tm, Yb, and Lu. In the R-T-B based sintered magnet according to the present embodiment, "R" essentially contains Tb and Nd. In addition, "R" may contain Pr and/or Dy.

The content of "R" in the R-T-B based sintered magnet according to the present embodiment is 28.0 mass % or more and 32.0 mass % or less with respect to 100 mass % of the entire R-T-B based sintered magnet. The coercivity HcJ decreases when the content of "R" is less than 28.0 mass %. The residual magnetic flux density Br decreases when the content of "R" exceeds 32.0 mass %. The content of "R" is preferably 29.0 mass % or more and 31.5 mass % or less.

Furthermore, in the R-T-B based sintered magnet of the present embodiment, "R" may contain heavy rare earth elements consisting of substantially only Dy and Tb. This makes it possible to efficiently improve the magnetic properties. Incidentally, what "R" contains heavy rare earth elements consisting of substantially only Dy and Tb means that the content of Dy and Tb is 98 mass % or more with respect to 100 mass % of the entire heavy rare earth elements.

Furthermore, in the R-T-B based sintered magnet of the present embodiment, "R" may contain a heavy rare earth element consisting of substantially only Tb. This makes it possible to most efficiently improve the magnetic properties. Incidentally, what "R" contains a heavy rare earth element consisting of substantially only Tb means that the content of Tb is 98 mass % or more with respect to 100 mass % of the entire heavy rare earth elements.

"T" represents an element such as a metal element other than rare earth elements. In the R-T-B based sintered magnet according to the present embodiment, "T" contains at least Fe, Co, Cu, Al, and Mn. For example, "T" may further contain one or more kinds of elements among the elements such as metal elements such as Ti, V, Cr, Ni, Nb, Mo, Ag, Hf, Ta, W, Si, P, Bi, Sn, Ga, and Zr. "T" preferably contains Ga or Zr, and more preferably contains Ga and Zr.

The content of Fe in the R-T-B based sintered magnet according to the present embodiment is substantially the remainder in the constituents of the R-T-B based sintered magnet.

The content of Co is 0.50 mass % or more and 3.0 mass % or less. The corrosion resistance is improved by containing Co. The corrosion resistance of the R-T-B based sintered magnet to be finally obtained deteriorates when the content of Co is less than 0.50 mass %. The cost increases as well as the effect of improving the corrosion resistance reaches the peak when the content of Co exceeds 3.0 mass %. The content of Co is preferably 1.0 mass % or more and 2.5 mass % or less.

The content of Cu is 0.04 mass % or more and 0.50 mass % or less. The coercivity HcJ decreases when the content of Cu is less than 0.04 mass %. The residual magnetic flux density Br decreases when the content of Cu exceeds 0.50 mass %. In addition, the content of Cu is preferably 0.10 mass % or more and 0.50 mass % or less.

The content of Al is 0.15 mass % or more and 0.40 mass % or less. The coercivity HcJ decreases when the content of Al is less than 0.15 mass %. Furthermore, the change in magnetic properties (particularly coercivity HcJ) with respect to the change in aging temperature to be described later increases, and thus the fluctuation in properties at the time of mass production increases. That is, the manufacturing stability decreases. The residual magnetic flux density Br decreases and the temperature change rate of the coercivity HcJ deteriorates when the content of Al exceeds 0.40 mass %. The content of Al is preferably 0.18 mass % or more and 0.30 mass % or less.

The content of Mn is 0.02 mass % or more and 0.10 mass % or less. The residual magnetic flux density Br decreases when the content of Mn is less than 0.02 mass %. The coercivity HcJ decreases when the content of Mn exceeds 0.10 mass %. The content of Mn is preferably 0.02 mass % or more and 0.06 mass % or less.

The content of Ga is preferably 0.08 mass % or more and 0.30 mass % or less. The coercivity HcJ is improved by containing Ga at 0.08 mass % or more. In addition, a different phase is less likely to be generated at the time of aging treatment and the residual magnetic flux density Br is improved by setting the content of Ga to 0.30 mass % or less. The content of Ga is even more preferably 0.10 mass % or more and 0.25 mass % or less.

The content of Zr is preferably 0.10 mass % or more and 0.25 mass % or less. The abnormal grain growth at the time of sintering is reduced and the squareness ratio (Hk/HcJ) and magnetizing rate in a low magnetic field are improved by containing Zr at 0.10 mass % or more. The residual magnetic flux density Br is improved by containing Zr at 0.25 mass % or less. The content of Zr is even more preferably 0.13 mass % or more and 0.22 mass % or less. Hk denotes a magnetic field value point at the intersection of the demagnetization curve of second quadrant and 90% line of the residual magnetic density Br.

In addition, Ga/Al is preferably 0.60 or more and 1.30 or less. This improves the coercivity HcJ. Furthermore, this decreases the change in magnetic properties (coercivity HcJ) with respect to the change in aging temperature described later, and decreases the fluctuation in properties at the time of mass production. That is, the manufacturing stability increases.

The term "B" in the "R-T-B based sintered magnet" according to the present embodiment represents boron (B) or boron (B) and carbon (C). That is, in the R-T-B based sintered magnet according to the present embodiment, a portion of boron (B) may be substituted with carbon (C).

The content of "B" in the R-T-B based sintered magnet according to the present embodiment is 0.85 mass % or more and 1.0 mass % or less. High squareness ratio is hard to be achieved when "B" is less than 0.85 mass %. That is, the squareness ratio (Hk/HcJ) is hard to be improved. The residual magnetic flux density Br decreases when "B" is 1.0 mass % or more. In addition, the content of "B" is preferably 0.90 mass % or more and 1.0 mass % or less.

The preferred content of carbon (C) in the R-T-B based sintered magnet according to the present embodiment varies depending on other parameters, but it is generally in a range of 0.05 to 0.15 mass %.

In the R-T-B based sintered magnet according to the present embodiment, the amount of nitrogen (N) is preferably 100 to 1000 ppm, even more preferably 200 to 800 ppm, and particularly preferably 300 to 600 ppm.

In the R-T-B based sintered magnet according to the present embodiment, the amount of oxygen (O) is preferably 2500 ppm or less, and even more preferably 500 ppm or more and 1500 ppm or less.

Incidentally, a conventionally generally known method can be used for measuring the various kinds of components contained in the R-T-B based sintered magnet according to the present embodiment. The amounts of the various kinds of metal elements are measured, for example, by fluorescent X-ray analysis and inductively coupled plasma emission spectroscopic analysis (ICP analysis). The amount of oxygen is measured, for example, by an inert gas fusion-nondispersive infrared absorption method. The amount of carbon is measured, for example, by a combustion in oxygen stream-infrared absorption method. The amount of nitrogen is measured, for example, by an inert gas fusion-thermal conductivity method.

As described above, the R-T-B based sintered magnet according to the present embodiment has a concentration distribution such that Tb2/Tb 1 is 0.40 or more and less than 1.0, where Tb1 (mass %) denotes the content of Tb at the surface portion and Tb2 (mass %) denotes the content of Tb at the core portion. In the present embodiment, it is preferable that the R-T-B based sintered magnet to be finally obtained has the above composition, but the R-T-B based sintered magnet having a composition included in the present invention is likely to have Tb2/Tb1 in a preferred range without being subjected to a special treatment.

Furthermore, the Tb content at the core portion can be increased when Tb is easily diffused to the core portion of the magnet bulk, and the thermal demagnetization properties can be thus improved. Specifically, the magnetic properties at the core portion at a high temperature of approximately 100 to 200° C. can be improved. In this case, the coercivity at the core portion can be particularly increased. Thus, the occurrence of thermal demagnetization due to the coercivity distribution can be reduced.

The R-T-B based sintered magnet according to the present embodiment includes a plurality of main phase grains and grain boundaries. The main phase grain is preferably a core-shell grain consisting of a core and a shell covering the core. Moreover, it is preferable that a heavy rare earth element is present at least in the shell, and it is particularly preferable that Tb is present at least in the shell.

It is possible to efficiently improve the magnetic properties of the R-T-B based sintered magnet by allowing a heavy rare earth element to be present at the shell portion.

In the present embodiment, the shell is defined as the part at which a proportion (heavy rare earth element/light rare earth element (molar ratio)) of the heavy rare earth element to the light rare earth element is two times or more the proportion at the core portion (core) of the main phase grain.

The thickness of the shell is not particularly limited, but is preferably 500 nm or less. The particle diameter of the main phase grains is not particularly limited either, but is preferably 3.0 μm or more and 6.5 μm or less.

The method for forming the main phase grains into the above core-shell grain is not particularly limited. For example, there is a method by grain boundary diffusion described later. A shell having a high proportion of a heavy rare earth element is formed as the heavy rare earth element is diffused to the grain boundaries and the heavy rare earth element substitutes the rare earth element "R" on the surface of the main phase grains, whereby the core-shell grain is obtained.

Hereinafter, the method for manufacturing an R-T-B based sintered magnet will be described in detail, but known methods may be used for matters that are not specifically stated.

[Preparation Step of Raw Material Powder]

The raw material powder can be fabricated by a known method. In the present embodiment, one alloy method using a single alloy will be described, but a so-called two alloy method, which a raw material powder is fabricated by mixing two or more kinds of alloys such as the first alloy and the second alloy of different compositions, may be used.

First, an alloy that mainly forms the main phase of the R-T-B based sintered magnet is prepared (alloy preparation step). In the alloy preparation step, an alloy having a desired composition is fabricated by melting the raw material metal corresponding to the composition of the R-T-B based sintered magnet according to the present embodiment by a known method and then casting it.

As the raw material metal, for example, it is possible to use a rare earth metal or a rare earth alloy, pure iron, ferroboron, and further an alloy or a compound of these. The method for casting the raw material metal is not particularly limited. A strip casting method is preferable in order to obtain an R-T-B based sintered magnet having high magnetic properties. The raw material alloy thus obtained may be subjected to homogenization by a known manner, if necessary. At this time point, the heavy rare earth element to be added to the raw material metal may be only Dy, or no heavy rare earth element may be added. In particular, it is preferable not to add Tb at this time point but to add Tb only by grain boundary diffusion described later from the viewpoint of the cost of raw material.

The alloy is pulverized after being fabricated (pulverization step). Incidentally, the atmosphere in each step from the pulverization step to the sintering step is preferably set to have a low oxygen concentration avoiding from oxidation. Thus, high magnetic properties can be obtained. For example, it is preferable to set the concentration of oxygen in each step to 200 ppm or less.

Hereinafter, the pulverization step conducted by two stages of a coarse pulverization step to pulverize the raw material alloy so as to have a particle diameter of about from several hundreds μm to several mm and a fine pulverization step to pulverize the raw material alloy so as to have a particle diameter of about several μm is described, but the pulverization step may be conducted by one stage of only the fine pulverization step.

In the coarse pulverization step, the raw material alloy is coarsely pulverized so as to have a particle diameter of about several hundreds μm to several mm. A coarsely pulverized powder is hereby obtained. The method for the coarse pulverization is not particularly limited, and the coarse pulverization can be conducted by any known method, such as a method conducting hydrogen storage pulverization and a method using a coarse pulverizer.

Next, the coarsely pulverized powder thus obtained is finely pulverized so as to have an average particle diameter of about several μm (fine pulverization step). A finely pulverized powder is hereby obtained. The average particle diameter of the finely pulverized powder is preferably 1 μm or more and 10 μm or less, more preferably 2 μm or more and 6 μm or less, and even more preferably 3 μm or more and 5 μm or less.

The method for the fine pulverization is not particularly limited. For example, the fine pulverization is conducted by a method using various kinds of fine pulverizers.

When finely pulverizing the coarsely pulverized powder, a finely pulverized powder exhibiting high orientation at the time of pressing can be obtained by adding various kinds of pulverization aids such as lauric acid amide and oleic acid amide.

[Pressing Step]

In the pressing step, the finely pulverized powder is pressed into the intended shape. The pressing step is not particularly limited, but in the present embodiment, the finely pulverized powder is filled in a mold and pressed in a magnetic field. In the green compact thus obtained, the main phase crystal is oriented in a specific direction, and thus an R-T-B based sintered magnet having a higher residual magnetic flux density Br is obtained.

The pressure of 20 MPa to 300 MPa may be applied. The magnetic field of 950 kA/m to 1600 kA/m may be applied. The magnetic field to be applied is not limited to a static magnetic field, and may be a pulsed magnetic field. It is also possible to concurrently use a static magnetic field and a pulsed magnetic field.

Incidentally, as the pressing method, it is possible to apply wet pressing to press a slurry prepared by dispersing the finely pulverized powder in a solvent such as oil in addition to dry pressing to press the finely pulverized powder as it is as described above.

The green compact obtained by pressing the finely pulverized powder can have any shape. The density of the green compact at this time point is preferably set to 4.0 to 4.3 $Mg/m^3$.

[Sintering Step]

The sintering step is a step to obtain a sintered body by sintering the green compact in a vacuum or an inert gas atmosphere. The sintering temperature is required to be adjusted depending on the conditions such as the composition, the pulverization method, the particle diameter, and the particle diameter distribution, but for example, the green compact is sintered by being heated for 1 hour or longer and 20 hours or shorter at 1000° C. or higher and 1200° C. or lower in a vacuum or in the presence of an inert gas. A sintered body having a high density is hereby obtained. In the present embodiment, a sintered body having a density of at least 7.48 $Mg/m^3$ or more, preferably 7.50 $Mg/m^3$ or more, is obtained.

[Aging Treatment Step]

The aging treatment step is a step to heat the sintered body at a temperature lower than the sintering temperature. The aging treatment may be conducted or may not be conducted. The number of aging treatments is not particularly limited either. The aging treatment is appropriately conducted according to the desired magnetic properties. A grain boundary diffusion step described later may also serve as the aging treatment step in the case of employing the grain boundary diffusion step. In the R-T-B based sintered magnet according to the present embodiment, the aging treatment may not be essentially conducted before the grain boundary diffusion step in the case of conducting the grain boundary diffusion step. Apart from the grain boundary diffusion step, it is the most preferable to conduct two aging treatments. Hereinafter, an embodiment to conduct two aging treatments will be described.

The aging step of the first time is denoted as the first aging step, and the aging step of the second time is denoted as the second aging step. The aging temperature in the first aging step is denoted as T1, and the aging temperature in the second aging step is denoted as T2.

The temperature T1 and aging time in the first aging step are not particularly limited, but are preferably 700° C. or higher and 900° C. or lower and 1 to 10 hours.

The temperature T2 and aging time in the second aging step are not particularly limited, but are preferably a temperature of 500° C. or higher and 700° C. or lower and 1 to 10 hours.

These aging treatments can improve the magnetic properties, particularly, the coercivity HcJ of the R-T-B based sintered magnet to be finally obtained.

[Machining Step (Before Grain Boundary Diffusion)]

There may be a step to machine the sintered body into a desired shape before subjecting the sintered body to the grain boundary diffusion, if necessary. Examples of the machining method may include a shaping process such as cutting and grinding and chamfering such as barrel polishing.

[Grain Boundary Diffusion Step]

Hereinafter, the method for grain boundary diffusion of Tb into the sintered body will be described.

The grain boundary diffusion can be conducted by depositing a compound or alloy containing a heavy rare earth element (Tb in the present embodiment) on the surface of the sintered body subjected to a pretreatment if necessary by coating, vapor deposition, or the like and then heating the resultant sintered body. The grain boundary diffusion of the heavy rare earth element can further improve the coercivity HcJ of the R-T-B based sintered magnet to be finally obtained.

Incidentally, the matters of the pretreatment are not particularly limited. Examples thereof may include a pretreatment in which the sintered body is etched by a known method, then washed, and dried.

In the present embodiment described below, a coating material containing Tb is prepared, and the coating material is coated on the surface of the sintered body.

The aspect of the coating material is not particularly limited. There is no limitation for the compound containing Tb to be used and the solvent or dispersion medium to be used. The kind of solvent or dispersion medium is not particularly limited either. The concentration of the coating material is not particularly limited either.

The temperature for diffusion treatment in the grain boundary diffusion step according to the present embodiment is preferably 800 to 950° C. The time for diffusion treatment is preferably 1 to 50 hours.

Setting the temperature and time for diffusion treatment to those described above makes it easier to keep the manufacturing cost low and control the concentration distribution (Tb2/Tb1) of Tb within a predetermined range.

The manufacturing stability of the R-T-B based sintered magnet according to the present embodiment can be confirmed by the degree of the amount of change in magnetic properties with respect to the change in aging temperature and/or temperature for diffusion treatment in the aging step and/or the grain boundary diffusion step. Hereinafter, the diffusion treatment step will be described, but the same is also applied to the aging step.

For example, when the amount of change in magnetic properties with respect to the change in temperature for diffusion treatment is large, the magnetic properties change as the temperature for diffusion treatment slightly changes. Hence, the range of the temperature for diffusion treatment allowed in the grain boundary diffusion step is narrow, and thus the manufacturing stability decreases. In contrast, when the amount of change in magnetic properties with respect to the change in temperature for diffusion treatment is small, the magnetic properties hardly change even though the temperature for diffusion treatment changes. Hence, the range of the temperature for diffusion treatment allowed in the grain boundary diffusion step is broad, and thus the manufacturing stability increases. Furthermore, it is possible to conduct the grain boundary diffusion at a higher temperature in a shorter time, and thus the manufacturing cost can be cut down.

A heat treatment may be further conducted after the diffusion treatment. The temperature for heat treatment in this case is preferably 450 to 600° C. The time for heat treatment is preferably 1 to 10 hours.

[Machining Step (after Grain Boundary Diffusion)]

It is preferable to conduct polishing in order to remove the coating material remaining on the surface of the principal plane after the grain boundary diffusion step.

The kind of machining to be conducted in the machining step after the grain boundary diffusion is not particularly limited. For example, a shaping process such as cutting and grinding or chamfering such as barrel polishing may be conducted after the grain boundary diffusion.

Incidentally, in the present embodiment, the machining step is conducted before and after the grain boundary diffusion, but these steps are not required to be necessarily conducted. In addition, the grain boundary diffusion step may also serve as the aging step as described above. The heating temperature in a case in which the grain boundary diffusion step also serves as the aging step is not particularly limited. The temperature is a preferred temperature in the grain boundary diffusion step, and it is particularly preferable to conduct the aging step at a preferred temperature as well.

The R-T-B based sintered magnet according to the present embodiment obtained by the method described above is magnetized so as to be an R-T-B based sintered magnet product.

The R-T-B based sintered magnet according to the present embodiment thus obtained has the desired properties. Specifically, it has a high residual magnetic flux density Br and a high coercivity HcJ, and also exhibits excellent corrosion resistance and excellent manufacturing stability.

The R-T-B based sintered magnet according to the present embodiment is suitably used for applications such as a motor and an electrical generator.

Incidentally, the present invention is not limited to the embodiments described above, but can be variously modified within the scope thereof.

EXAMPLES

Hereinafter, the present invention will be described with reference to further detailed Examples, but is not limited to these Examples.

Experimental Example 1

(Fabrication of Rare Earth Sintered Magnet Base Material (Rare Earth Sintered Magnet Body))

As raw materials, Nd, Pr (purity of 99.5% or more), a Dy-Fe alloy, electrolytic iron, and a low-carbon ferroboron alloy were prepared. Furthermore, Al, Ga, Cu, Co, Mn, and Zr were prepared in the form of a pure metal or an alloy with Fe.

Alloys for sintered body (raw material alloys) having the respective compositions presented in Table 1 below were fabricated from the raw materials by the strip casting method. Incidentally, the alloy thickness of the raw material alloys was set to 0.2 to 0.4 mm.

Subsequently, hydrogen was stored in the raw material alloy by allowing a hydrogen gas to flow through the raw material alloy for 1 hour at room temperature. Subsequently, the atmosphere was switched to an Ar gas, and the dehydrogenation treatment was conducted for 1 hour at 600° C., thereby conducting the hydrogen pulverization of the raw material alloy. Furthermore, the resultant was cooled and then screened by using a sieve so as to obtain a powder having a grain size of 425 μm or less. Incidentally, a low-oxygen atmosphere having an oxygen concentration of less than 200 ppm was maintained all the time from the hydrogen pulverization to the sintering step described later.

Subsequently, oleic acid amide as a pulverization aid was added to the powder of the raw material alloy after the hydrogen pulverization at 0.1% by mass ratio and mixed.

Subsequently, the powder of the raw material alloy thus obtained was finely pulverized in a nitrogen stream by using an impact plate type jet mill apparatus to obtain a fine powder having an average particle diameter of 3.9 to 4.2 μm. Incidentally, the average particle diameter is the average particle diameter measured by a laser diffraction type particle size analyzer.

The fine powder thus obtained was pressed in a magnetic field to press a green compact. The magnetic field applied at this time was a static magnetic field of 1200 kA/m. The pressure applied at the time of pressing was 98 MPa. Incidentally, the magnetic field applying direction and the pressurizing direction were set to cross at right angles. The density of the green compact at this time was measured, and the density of all the green compacts was within a range of 4.10 to 4.25 $Mg/m^3$.

Next, the green compact was sintered to obtain a rare earth sintered magnet base material (hereinafter, also simply referred to as the base material). Although the optimum condition of the sintering condition is different according to the composition or the like, that the green compact was retained for 4 hours at a temperature in a range of 1040 to 1100° C. The sintering atmosphere was a vacuum. The density of the sintered body at this time was in a range of 7.51 to 7.53 $Mg/m^3$. Thereafter, at atmospheric pressure in an Ar atmosphere, the first aging treatment was conducted for 1 hour at the first aging temperature T1 of 850° C., and further the second aging treatment was conducted for 1 hour at the second aging temperature T2 of 520° C.

Thereafter, the base material was machined into 14 mm×10 mm×4.2 mm by a Surface Grinding Machine to fabricate a sintered body before the grain boundary diffusion of Tb described later.

(Tb Diffusion)

Furthermore, a treatment in which the sintered body obtained in the step described above was immersed in a mixed solution of nitric acid and ethanol composed of ethanol at 100 mass % and nitric acid at 3 mass % for 3 minutes and immersed in ethanol for 1 minute was conducted two times, thereby conducting the etching treatment of the sintered body. Subsequently, a slurry prepared by dispersing $TbH_2$ grains having an average particle diameter D50 of 10.0 μm in ethanol was coated on the entire surface of the base material after the etching treatment at 0.6 mass % by mass ratio of Tb mass to the magnet mass.

After being coated with the slurry, the base material was subjected to the diffusion treatment for 18 hours at 930° C. while allowing Ar to flow at atmospheric pressure and then subjected to the heat treatment for 4 hours at 520° C.

The average composition of the respective R-T-B based sintered magnets obtained by the heat treatment was measured. Two samples of 14×10×4.2 mm were pulverized by a stamp mill and subjected to analysis. The element amount of various metals was measured by fluorescent X-ray analysis. The amount of boron (B) was only measured by ICP analysis. The results are shown in Table 1 and Table 2.

Incidentally, H, Si, Ca, La, Ce, Cr, and the like may be detected in addition to O, N, and C among the elements that are not described in Table 1 or Table 2. Si is mainly mixed from the ferroboron raw material and the crucible at the time of melting the alloy. Ca, La, and Ce are mixed from the rare earth raw material. Cr may be mixed from electrolytic iron.

The surface of the respective R-T-B based sintered magnets obtained by the heat treatment was scraped off by 0.1 mm per each plane, and the magnetic properties thereof were evaluated by a BH tracer. The magnetic properties were evaluated after magnetizing the R-T-B based sintered magnets in a pulse magnetic field of 4000 kA/m. The thickness of the sintered body is thin, and thus three sheets of the sintered body were overlapped for the evaluation. The results are shown in Table 1 and Table 2.

Figure 2:
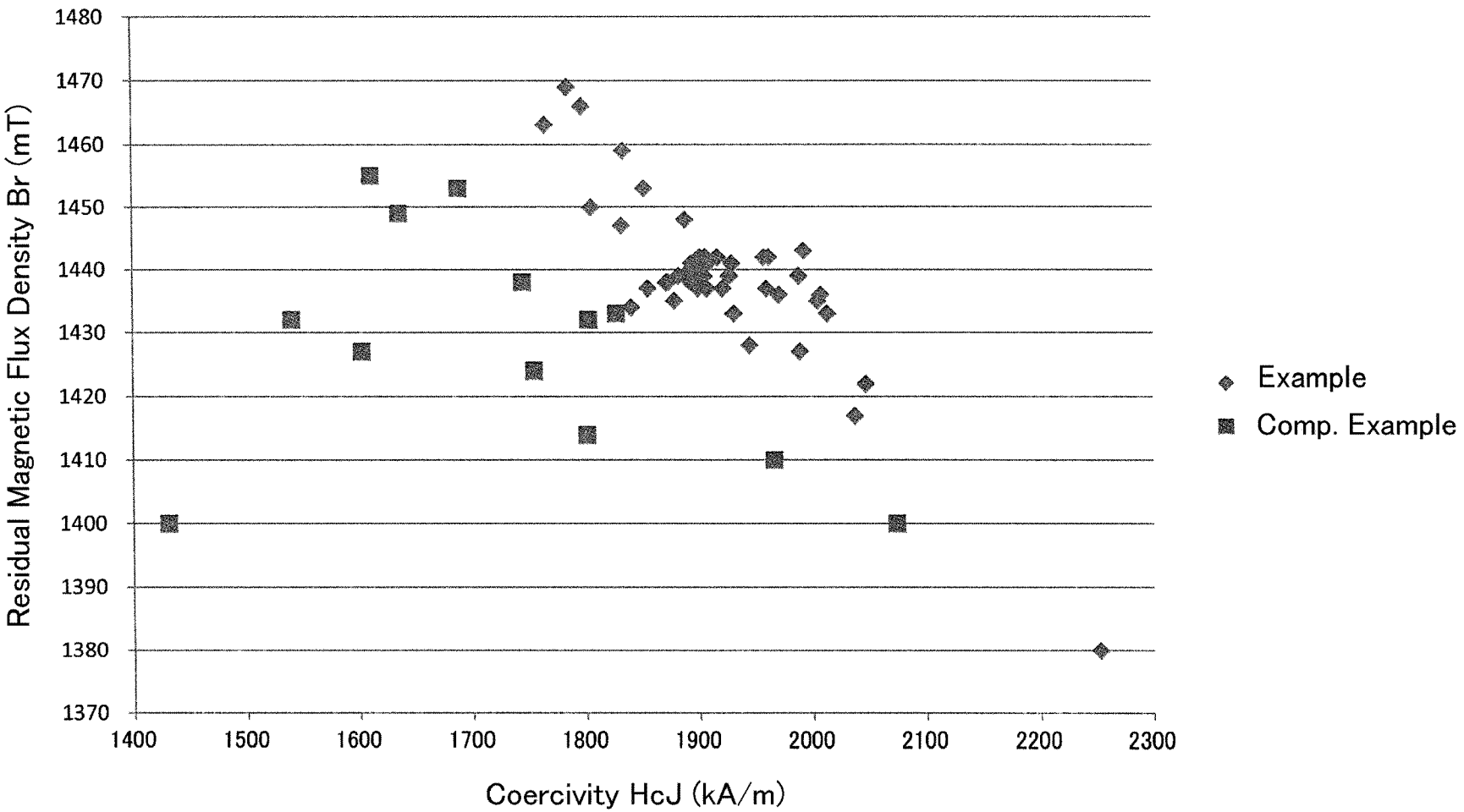
FIG. 2 is a Br-HcJ map in Examples and Comparative Examples.
Figure 3:
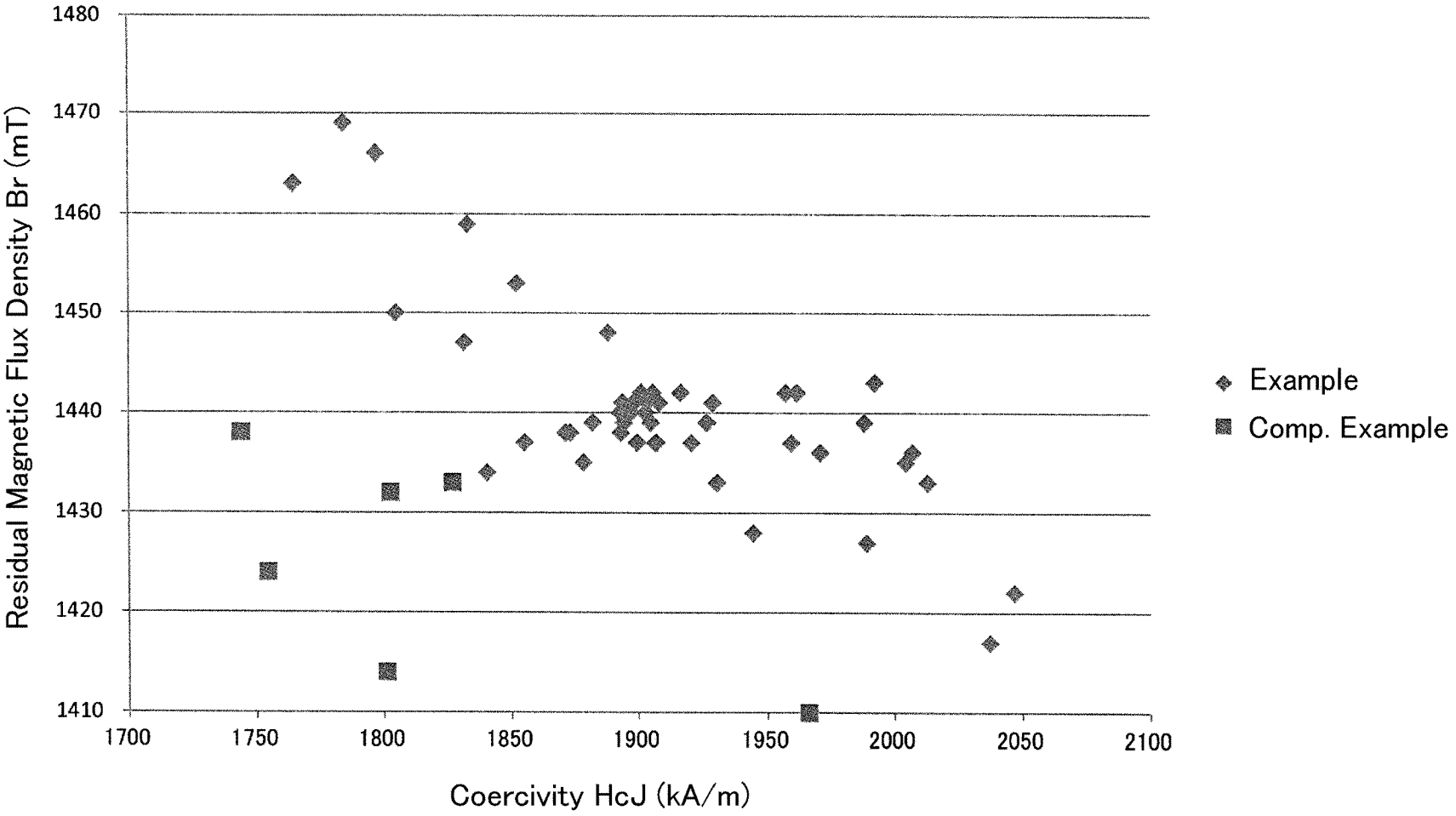
FIG. 3 is a Br-HcJ map in Examples and Comparative Examples.

The residual magnetic flux density Br and coercivity HcJ were evaluated in a comprehensive manner. Specifically, all Examples including Table 1, Table 2, and the results of Experimental Example 5 (Table 5) described later and all Comparative Examples other than Comparative Example 6 described later were plotted on a Br-HcJ map (graph taking Br in the vertical axis and HcJ in the horizontal axis). Samples on more upper-right side of the Br-HcJ map have more favorable Br and HcJ. FIG. 2 is the Br-HcJ map made from Table 1, Table 2, and Table 5, and FIG. 3 is the Br-HcJ map made by enlarging the place where a large number of samples are plotted in FIG. 2. In Table 1, Table 2, and Table 5, samples having favorable Br and HcJ are denoted as O, and samples having unfavorable Br and HcJ are denoted as ×.

In addition, the respective R-T-B based sintered magnets were subjected to a corrosion resistance test. The corrosion resistance test was conducted by a Pressure Cooker Test (PCT) at a saturated vapor pressure. Specifically, the R-T-B based sintered magnet was left for 1000 hours at 2 atm in an environment of 100% RH, and the change in mass before and after the test was measured. A mass change by 3 $mg/cm^2$ or less was considered to exhibit favorable corrosion resistance. The results are shown in Table 1 and Table 2. Samples exhibiting favorable corrosion resistance are denoted as O, and samples exhibiting unfavorable corrosion resistance are denoted as ×. Incidentally, Comparative Example 6, which has favorable Br and HcJ but is inferior in corrosion resistance, is not illustrated in FIG. 2 or FIG. 3 in order to clarify that all Examples have favorable Br and HcJ.

TABLE 1

| | Composition of R-T-B magnet | | | | | | | | | | Properties | | | |
|---|---|---|---|---|---|---|---|---|---|---|---|---|---|---|
| Sample number | Nd (wt %) | Tb (wt %) | B (wt %) | Al (wt %) | Ga (wt %) | Cu (wt %) | Co (wt %) | Mn (wt %) | Zr (wt %) | Ga/Al | Br (mT) | HcJ (kA/m) | Evaluation | Corrosion resistance |
| Comp. Example 1 | 30.4 | 0.33 | 0.95 | 0.12 | 0.20 | 0.20 | 2.00 | 0.04 | 0.15 | 1.67 | 1449 | 1636 | x | ○ |
| Example 1 | 30.3 | 0.39 | 0.95 | 0.15 | 0.20 | 0.20 | 2.00 | 0.04 | 0.15 | 1.25 | 1450 | 1805 | ○ | ○ |
| Example 1a | 30.3 | 0.42 | 0.95 | 0.16 | 0.20 | 0.20 | 2.00 | 0.04 | 0.15 | 1.25 | 1447 | 1832 | ○ | ○ |
| Example 2 | 30.2 | 0.44 | 0.95 | 0.20 | 0.20 | 0.20 | 2.00 | 0.04 | 0.15 | 1.00 | 1441 | 1929 | ○ | ○ |
| Example 3 | 30.2 | 0.45 | 0.95 | 0.24 | 0.20 | 0.20 | 2.00 | 0.04 | 0.15 | 0.83 | 1435 | 2004 | ○ | ○ |
| Example 4 | 30.3 | 0.42 | 0.95 | 0.30 | 0.20 | 0.20 | 2.00 | 0.04 | 0.15 | 0.67 | 1422 | 2047 | ○ | ○ |
| Comp. Example 3 | 30.3 | 0.40 | 0.95 | 0.42 | 0.20 | 0.20 | 2.00 | 0.04 | 0.15 | 0.48 | 1400 | 2074 | x | ○ |
| Example 5a | 30.3 | 0.35 | 0.95 | 0.20 | 0.08 | 0.20 | 2.00 | 0.04 | 0.15 | 0.40 | 1435 | 1878 | ○ | ○ |
| Example 5 | 30.2 | 0.37 | 0.95 | 0.20 | 0.10 | 0.20 | 2.00 | 0.04 | 0.15 | 0.50 | 1438 | 1873 | ○ | ○ |
| Example 6 | 30.2 | 0.37 | 0.95 | 0.20 | 0.15 | 0.20 | 2.00 | 0.04 | 0.15 | 0.75 | 1439 | 1882 | ○ | ○ |
| Example 2 | 30.2 | 0.44 | 0.95 | 0.20 | 0.20 | 0.20 | 2.00 | 0.04 | 0.15 | 1.00 | 1441 | 1929 | ○ | ○ |

TABLE 1-continued

| Sample number | Composition of R-T-B magnet | | | | | | | | | | Properties | | | |
|---|---|---|---|---|---|---|---|---|---|---|---|---|---|---|
| | Nd (wt %) | Tb (wt %) | B (wt %) | Al (wt %) | Ga (wt %) | Cu (wt %) | Co (wt %) | Mn (wt %) | Zr (wt %) | Ga/Al | Br (mT) | HcJ (kA/m) | Evaluation | Corrosion resistance |
| Example 7 | 30.2 | 0.41 | 0.95 | 0.20 | 0.25 | 0.20 | 2.00 | 0.04 | 0.15 | 1.25 | 1437 | 1921 | ○ | ○ |
| Example 8 | 30.2 | 0.39 | 0.95 | 0.20 | 0.30 | 0.20 | 2.00 | 0.04 | 0.15 | 1.50 | 1428 | 1944 | ○ | ○ |
| Comp. Example 4 | 30.3 | 0.30 | 0.95 | 0.20 | 0.20 | 0.02 | 2.00 | 0.04 | 0.15 | 1.00 | 1432 | 1540 | x | ○ |
| Example 9 | 30.2 | 0.37 | 0.95 | 0.20 | 0.20 | 0.04 | 2.00 | 0.04 | 0.15 | 1.00 | 1437 | 1855 | ○ | ○ |
| Example 10 | 30.2 | 0.37 | 0.95 | 0.20 | 0.20 | 0.08 | 2.00 | 0.04 | 0.15 | 1.00 | 1439 | 1894 | ○ | ○ |
| Example 11 | 30.2 | 0.40 | 0.95 | 0.20 | 0.20 | 0.12 | 2.00 | 0.04 | 0.15 | 1.00 | 1437 | 1899 | ○ | ○ |
| Example 12 | 30.2 | 0.42 | 0.95 | 0.20 | 0.20 | 0.16 | 2.00 | 0.04 | 0.15 | 1.00 | 1437 | 1907 | ○ | ○ |
| Example 2 | 30.2 | 0.44 | 0.95 | 0.20 | 0.20 | 0.20 | 2.00 | 0.04 | 0.15 | 1.00 | 1441 | 1929 | ○ | ○ |
| Example 13 | 30.2 | 0.42 | 0.95 | 0.20 | 0.20 | 0.24 | 2.00 | 0.04 | 0.15 | 1.00 | 1439 | 1927 | ○ | ○ |
| Example 13a | 30.2 | 0.41 | 0.95 | 0.20 | 0.20 | 0.50 | 2.00 | 0.04 | 0.15 | 1.00 | 1433 | 1931 | ○ | ○ |
| Comp. Example 5 | 30.2 | 0.43 | 0.95 | 0.20 | 0.20 | 1.00 | 2.00 | 0.04 | 0.15 | 1.00 | 1414 | 1801 | x | ○ |
| Comp. Example 6 | 30.3 | 0.40 | 0.95 | 0.20 | 0.20 | 0.20 | 0.40 | 0.04 | 0.15 | 1.00 | 1437 | 1903 | ○ | x |
| Example 14a | 30.3 | 0.40 | 0.95 | 0.20 | 0.20 | 0.20 | 0.50 | 0.04 | 0.15 | 1.00 | 1438 | 1893 | ○ | ○ |
| Example 14 | 30.3 | 0.40 | 0.95 | 0.20 | 0.20 | 0.20 | 0.80 | 0.04 | 0.15 | 1.00 | 1442 | 1916 | ○ | ○ |
| Example 15 | 30.3 | 0.39 | 0.95 | 0.20 | 0.20 | 0.20 | 1.20 | 0.04 | 0.15 | 1.00 | 1439 | 1905 | ○ | ○ |
| Example 16 | 30.3 | 0.40 | 0.95 | 0.20 | 0.20 | 0.20 | 1.60 | 0.04 | 0.15 | 1.00 | 1442 | 1906 | ○ | ○ |
| Example 2 | 30.2 | 0.44 | 0.95 | 0.20 | 0.20 | 0.20 | 2.00 | 0.04 | 0.15 | 1.00 | 1441 | 1929 | ○ | ○ |
| Example 17 | 30.3 | 0.37 | 0.95 | 0.20 | 0.20 | 0.20 | 2.40 | 0.04 | 0.15 | 1.00 | 1437 | 1907 | ○ | ○ |
| Example 18 | 30.3 | 0.35 | 0.95 | 0.20 | 0.20 | 0.20 | 3.00 | 0.04 | 0.15 | 1.00 | 1440 | 1897 | ○ | ○ |
| Comp. Example 7a | 30.3 | 0.38 | 0.95 | 0.20 | 0.20 | 0.20 | 2.00 | 0.01 | 0.15 | 1.00 | 1433 | 1827 | x | ○ |
| Example 19 | 30.3 | 0.39 | 0.95 | 0.20 | 0.20 | 0.20 | 2.00 | 0.02 | 0.15 | 1.00 | 1441 | 1908 | ○ | ○ |
| Example 2 | 30.2 | 0.44 | 0.95 | 0.20 | 0.20 | 0.20 | 2.00 | 0.04 | 0.15 | 1.00 | 1441 | 1929 | ○ | ○ |
| Example 20 | 30.3 | 0.41 | 0.95 | 0.20 | 0.20 | 0.20 | 2.00 | 0.06 | 0.15 | 1.00 | 1441 | 1898 | ○ | ○ |
| Example 21 | 30.3 | 0.44 | 0.95 | 0.20 | 0.20 | 0.20 | 2.00 | 0.08 | 0.15 | 1.00 | 1441 | 1903 | ○ | ○ |
| Example 22 | 30.3 | 0.42 | 0.95 | 0.20 | 0.20 | 0.20 | 2.00 | 0.10 | 0.15 | 1.00 | 1441 | 1894 | ○ | ○ |
| Comp. Example 7 | 30.3 | 0.39 | 0.95 | 0.20 | 0.20 | 0.20 | 2.00 | 0.15 | 0.15 | 1.00 | 1432 | 1803 | x | ○ |
| Example 24a | 30.2 | 0.35 | 0.95 | 0.20 | 0.20 | 0.20 | 2.00 | 0.04 | 0.10 | 1.00 | 1438 | 1871 | ○ | ○ |
| Example 24 | 30.2 | 0.36 | 0.95 | 0.20 | 0.20 | 0.20 | 2.00 | 0.04 | 0.12 | 1.00 | 1400 | 1893 | ○ | ○ |
| Example 2 | 30.2 | 0.44 | 0.95 | 0.20 | 0.20 | 0.20 | 2.00 | 0.04 | 0.15 | 1.00 | 1441 | 1929 | ○ | ○ |
| Example 25 | 30.2 | 0.40 | 0.95 | 0.20 | 0.20 | 0.20 | 2.00 | 0.04 | 0.18 | 1.00 | 1440 | 1903 | ○ | ○ |
| Example 26 | 30.2 | 0.41 | 0.95 | 0.20 | 0.20 | 0.20 | 2.00 | 0.04 | 0.21 | 1.00 | 1442 | 1957 | ○ | ○ |
| Example 27 | 30.2 | 0.41 | 0.95 | 0.20 | 0.20 | 0.20 | 2.00 | 0.04 | 0.25 | 1.00 | 1442 | 1961 | ○ | ○ |

TABLE 2

| Sample number | Composition of R-T-B magnet | | | | | | | | | | | Properties | | |
|---|---|---|---|---|---|---|---|---|---|---|---|---|---|---|
| | Nd (wt %) | Dy (wt %) | Tb (wt %) | B (wt %) | Al (wt %) | Ga (wt %) | Cu (wt %) | Co (wt %) | Mn (wt %) | Zr (wt %) | Ga/Al | Br (mT) | HcJ (kA/m) | Corrosion resistance |
| Comp. Example 11 | 27.3 | 0.0 | 0.31 | 0.95 | 0.20 | 0.20 | 0.20 | 2.00 | 0.04 | 0.15 | 1.00 | 1453 | 1688 | ○ |
| Example 31 | 27.7 | 0.0 | 0.33 | 0.95 | 0.20 | 0.20 | 0.20 | 2.00 | 0.04 | 0.15 | 1.00 | 1463 | 1764 | ○ |
| Example 32 | 28.4 | 0.0 | 0.33 | 0.95 | 0.20 | 0.20 | 0.20 | 2.00 | 0.04 | 0.15 | 1.00 | 1469 | 1784 | ○ |
| Example 33 | 28.7 | 0.0 | 0.37 | 0.95 | 0.20 | 0.20 | 0.20 | 2.00 | 0.04 | 0.15 | 1.00 | 1466 | 1797 | ○ |
| Example 34 | 29.1 | 0.0 | 0.36 | 0.95 | 0.20 | 0.20 | 0.20 | 2.00 | 0.04 | 0.15 | 1.00 | 1459 | 1833 | ○ |
| Example 35 | 29.6 | 0.0 | 0.39 | 0.95 | 0.20 | 0.20 | 0.20 | 2.00 | 0.04 | 0.15 | 1.00 | 1453 | 1852 | ○ |
| Example 36 | 30.0 | 0.0 | 0.42 | 0.95 | 0.20 | 0.20 | 0.20 | 2.00 | 0.04 | 0.15 | 1.00 | 1448 | 1888 | ○ |
| Example 2 | 30.2 | 0.0 | 0.44 | 0.95 | 0.20 | 0.20 | 0.20 | 2.00 | 0.04 | 0.15 | 1.00 | 1441 | 1929 | ○ |
| Example 37 | 30.6 | 0.0 | 0.43 | 0.95 | 0.20 | 0.20 | 0.20 | 2.00 | 0.04 | 0.15 | 1.00 | 1437 | 1959 | ○ |
| Example 38 | 31.5 | 0.0 | 0.44 | 0.95 | 0.20 | 0.20 | 0.20 | 2.00 | 0.04 | 0.15 | 1.00 | 1427 | 1989 | ○ |
| Comp. Example 12 | 32.0 | 0.0 | 0.42 | 0.95 | 0.20 | 0.20 | 0.20 | 2.00 | 0.04 | 0.15 | 1.00 | 1410 | 1966 | ○ |
| Comp. Example 13 | 30.2 | 0.0 | 0.41 | 0.80 | 0.20 | 0.20 | 0.20 | 2.00 | 0.04 | 0.15 | 1.00 | 1427 | 1603 | ○ |
| Example 39 | 30.2 | 0.0 | 0.43 | 0.85 | 0.20 | 0.20 | 0.20 | 2.00 | 0.04 | 0.15 | 1.00 | 1436 | 1971 | ○ |
| Example 40 | 30.2 | 0.0 | 0.44 | 0.90 | 0.20 | 0.20 | 0.20 | 2.00 | 0.04 | 0.15 | 1.00 | 1443 | 1992 | ○ |
| Example 2 | 30.2 | 0.0 | 0.44 | 0.95 | 0.20 | 0.20 | 0.20 | 2.00 | 0.04 | 0.15 | 1.00 | 1441 | 1929 | ○ |
| Example 41 | 30.2 | 0.0 | 0.42 | 1.00 | 0.20 | 0.20 | 0.20 | 2.00 | 0.04 | 0.15 | 1.00 | 1434 | 1840 | ○ |
| Comp. Example14 | 30.2 | 0.0 | 0.40 | 1.05 | 0.20 | 0.20 | 0.20 | 2.00 | 0.04 | 0.15 | 1.00 | 1424 | 1754 | ○ |
| Example 2 | 30.2 | 0.0 | 0.44 | 0.95 | 0.20 | 0.20 | 0.20 | 2.00 | 0.04 | 0.15 | 1.00 | 1441 | 1929 | ○ |
| Example 43 | 29.3 | 1.0 | 0.43 | 0.95 | 0.20 | 0.20 | 0.20 | 2.00 | 0.04 | 0.15 | 1.00 | 1417 | 2037 | ○ |
| Example 44 | 28.3 | 2.0 | 0.43 | 0.95 | 0.20 | 0.20 | 0.20 | 2.00 | 0.04 | 0.15 | 1.00 | 1380 | 2253 | ○ |

From Table 1, Table 2, FIG. 2, and FIG. 3, all Examples have favorable residual magnetic flux density Br and coercivity HcJ and exhibit favorable corrosion resistance. In contrast, one or more among the residual magnetic flux density Br, the coercivity HcJ, and the corrosion resistance are not favorable in all Comparative Examples.

Experimental Example 2

For Example 2 and Comparative Example 1, the properties of the R-T-B based sintered magnets finally obtained by changing the second aging temperature T2 were evaluated. The results are shown in Table 3 and FIG. 4.

TABLE 3

| Second aging temperature T2(° C.) | Example 2 HcJ(kA/m) | Comp. Example 1 HcJ(kA/m) |
|---|---|---|
| 470 | 1927 | 1621 |
| 500 | 1942 | 1660 |
| 520 | 1929 | 1636 |
| 560 | 1915 | 1581 |

Figure 4:
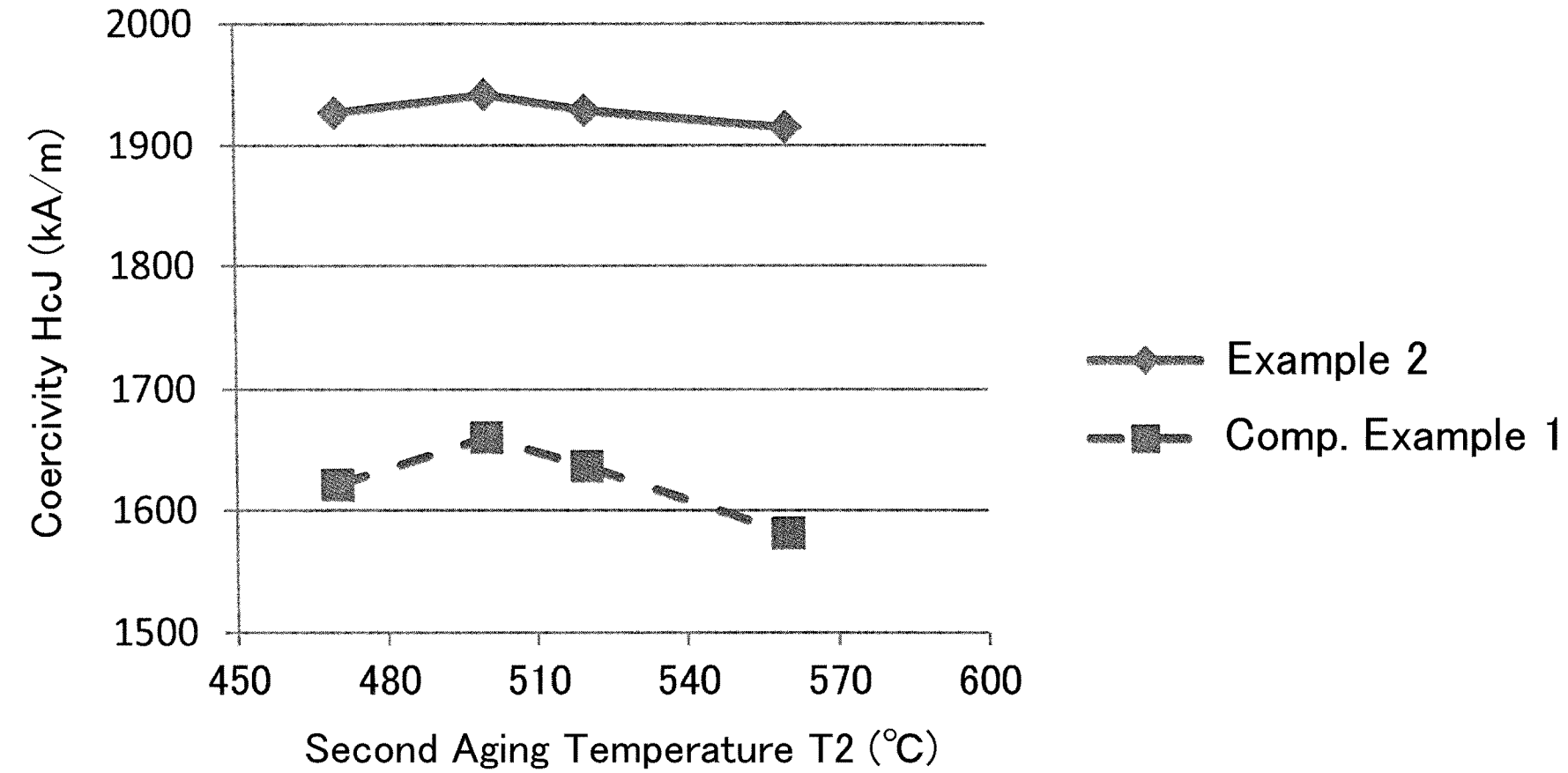
FIG. 4 is a diagram illustrating the relation between the coercivity HcJ and the second aging temperature in Experimental Example 2.

From Table 3 and FIG. 4, the change in properties (change in HcJ) with respect to the change in second aging temperature T2 is small in Example 2, in which the composition of Al or the like is within the range of the present invention, as compared to Comparative Example 1, in which the content of Al is too low.

Experimental Example 3

The residual magnetic flux density Br and coercivity HcJ of the R-T-B based sintered magnets finally obtained by changing the diffusion temperature at the time of subjecting the R-T-B based sintered magnets of Example 2 and Comparative Example 1 to the grain boundary diffusion were evaluated. The results are shown in Table 4, FIG. 5, and FIG. 6.

TABLE 4

| | Example 2 | | Comp. Example 1 | |
|---|---|---|---|---|
| Diffusion temperature | Br(mT) | HcJ(kA/m) | Br(mT) | HcJ(kA/m) |
| 850 | 1445 | 1901 | 1453 | 1554 |
| 900 | 1442 | 1919 | 1451 | 1598 |
| 930 | 1441 | 1929 | 1449 | 1636 |
| 950 | 1440 | 1915 | 1449 | 1632 |

Figure 5:
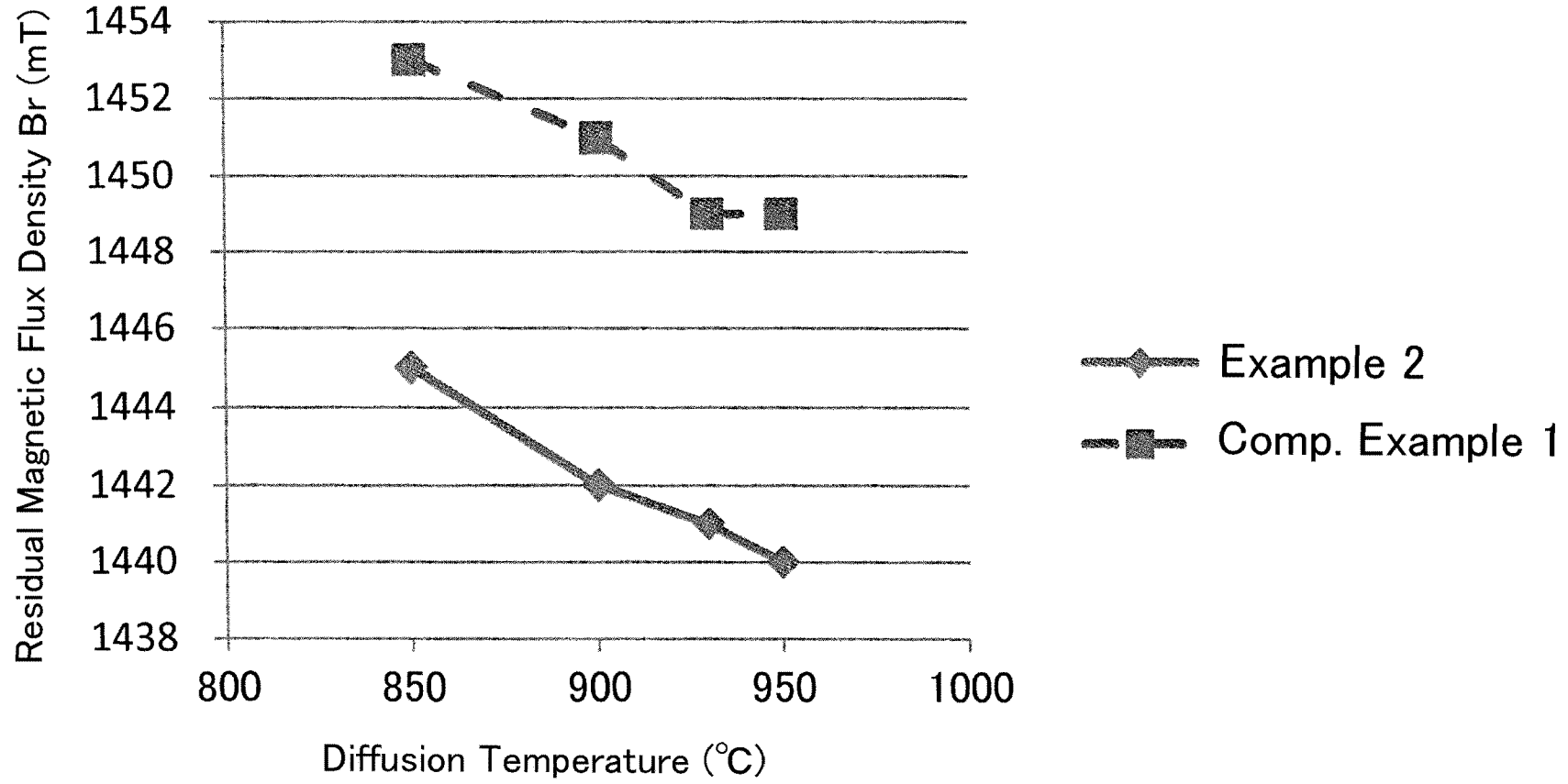
FIG. 5 is a diagram illustrating the relation between the residual magnetic flux density Br and the diffusion temperature in Experimental Example 3.
Figure 6:
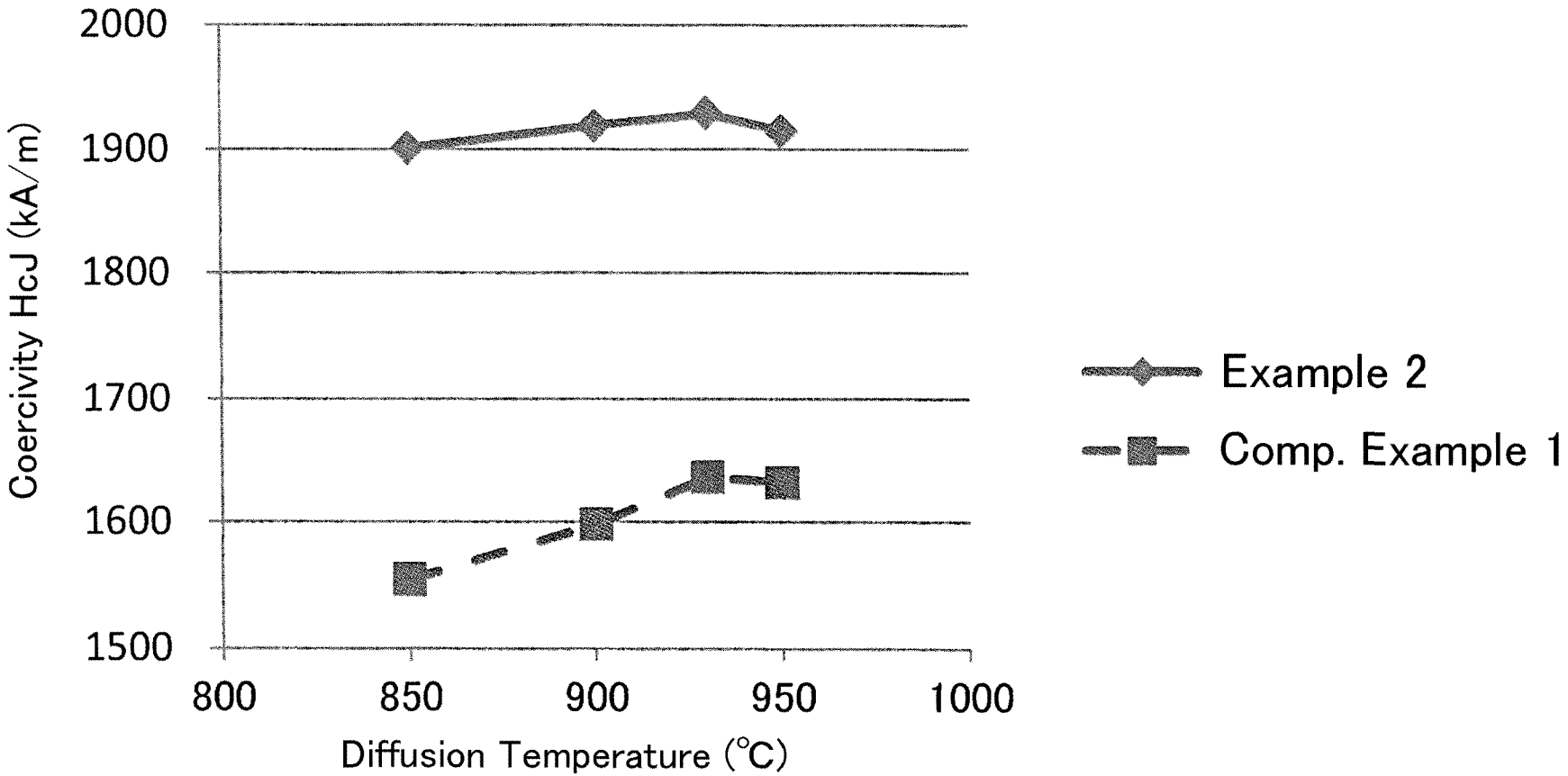
FIG. 6 is a diagram illustrating the relation between the coercivity HcJ and the diffusion temperature in Experimental Example 3.

From Table 4, FIG. 5, and FIG. 6, the change in residual magnetic flux density Br and coercivity HcJ with respect to the change in diffusion temperature is small in Example 2, in which the composition of Al or the like is within the range of the present invention, as compared to Comparative Example 1, in which the content of Al is too low.

Experimental Example 4

For Examples 2, 12, and 40 and Comparative Examples 1, 4, and 5, the Tb content at the core portion and the Tb content at the surface portion were measured. Specifically, for the R-T-B based sintered magnet obtained by Tb diffusion, the Tb content in the centroid (10 mm×7 mm×1 mm thick) of the plane having the largest area (14 mm×10 mm plane) among the planes obtained by scraping off the surface by 0.1 mm as described above was measured and adopted as the Tb content at the surface portion. Here, the analytical value was obtained by ICP analysis since the amount to be analyzed was small. In addition, for the R-T-B based sintered magnets obtained by Tb diffusion, the Tb content in the centroid (10 mm×7 mm×1 mm thick) of the plane having the largest area among the R-T-B based sintered magnets (1.0 mm thick) obtained by scraping off the surface by 1.5 mm was measured and adopted as the Tb content at the core portion. Here, the analytical value was obtained by ICP analysis since the amount to be analyzed was small. The results are shown in Table 5.

Furthermore, for the respective Examples and Comparative Examples, the surface of the respective R-T-B based sintered magnets was scraped off by 0.1 mm per each plane, and the R-T-B based sintered magnets were then heated to 140° C. and subjected to the measurement of coercivity HcJ at 140° C. Thereafter, samples satisfying (HcJ@140° C.—HcJ@RT)/HcJ@RT≥—9.8% are judged to exhibit favorable thermal demagnetization properties, where HcJ@140° C. denotes the coercivity HcJ at 140° C., and HcJ@RT denotes the coercivity HcJ at room temperature (22° C.). The results are shown in Table 5. In Table 5, samples exhibiting favorable thermal demagnetization properties are denoted as O, and samples exhibiting unfavorable thermal demagnetization properties are denoted as ×.

Experimental Example 5

Furthermore, Examples 52 to 54 were fabricated by changing the diffusion time in Example 2. Furthermore, Comparative Examples 21 and 22 were fabricated by changing the diffusion time in Comparative Example 1 and subjected to the same test. Furthermore, Comparative Example 23, in which the Tb content was set to 0.6 wt % by substituting a portion of Nd with Tb at the time of fabricating the base material instead of conducting the Tb diffusion in Comparative Example 5, was subjected to the same test. The results are shown in Table 5.

TABLE 5

| | Diffusion time (h) | Diffusion temperature (° C.) | Surface portion Tb1 (wt %) | Core portion Tb2 (wt %) | Tb2/Tb1 | Properties Br(mT) | HcJ (kA/m) | Evaluation | Thermal demagnetization |
|---|---|---|---|---|---|---|---|---|---|
| Example 2 | 18 | 930 | 0.64 | 0.40 | 0.63 | 1441 | 1929 | ○ | ○ |
| Example 12 | 18 | 930 | 0.66 | 0.41 | 0.62 | 1437 | 1907 | ○ | ○ |
| Example 40 | 18 | 930 | 0.64 | 0.37 | 0.58 | 1443 | 1992 | ○ | ○ |
| Example 51 | 24 | 930 | 0.66 | 0.37 | 0.56 | 1439 | 1988 | ○ | ○ |
| Example 52 | 12 | 930 | 0.68 | 0.33 | 0.49 | 1442 | 1901 | ○ | ○ |
| Example 53 | 36 | 930 | 0.66 | 0.47 | 0.71 | 1436 | 2007 | ○ | ○ |
| Example 54 | 120 | 880 | 0.66 | 0.53 | 0.80 | 1433 | 2013 | ○ | ○ |
| Comp. Example 1 | 18 | 930 | 0.78 | 0.25 | 0.32 | 1449 | 1636 | x | x |
| Comp. Example 4 | 18 | 930 | 0.72 | 0.21 | 0.29 | 1432 | 1540 | x | x |

TABLE 5-continued

| | Diffusion time (h) | Diffusion temperature (° C.) | Surface portion Tb1 (wt %) | Core portion Tb2 (wt %) | Tb2/Tb1 | Properties Br(mT) | HcJ (kA/m) | Evaluation | Thermal demagnetization |
|---|---|---|---|---|---|---|---|---|---|
| Comp. Example 5 | 18 | 930 | 0.70 | 0.22 | 0.31 | 1414 | 1801 | x | x |
| Comp. Example 21 | 12 | 930 | 0.80 | 0.21 | 0.26 | 1455 | 1611 | x | x |
| Comp. Example 22 | 36 | 930 | 0.76 | 0.27 | 0.36 | 1438 | 1744 | x | x |
| Comp. Example 23 | | Nil | 0.60 | 0.60 | 1.00 | 1400 | 1431 | x | x |

From Table 5, it can be seen that Tb is diffused to the core portion and the Tb concentration at the core portion is likely to be high in the R-T-B based sintered magnets of the present invention as compared to Comparative Examples. Moreover, it can be seen that the residual magnetic flux density Br, the coercivity HcJ, and the thermal demagnetization properties are excellent in the R-T-B based sintered magnets of the present invention as compared to Comparative Examples. It can be seen that excellent residual magnetic flux density Br, coercivity HcJ, and thermal demagnetization properties are obtained in the R-T-B based sintered magnets of the present invention as compared to a case in which Tb is added at the time of fabricating the base material instead of conducting the grain boundary diffusion.

REFERENCE SINGS LIST

1 . . . R-T-B based sintered magnet

The invention claimed is:

1. An R-T-B based sintered magnet comprising "R", "T", and "B", wherein

"R" represents a rare earth element including at least Tb,

"T" represents a metal element other than rare earth elements including at least Fe, Cu, Mn, Al, and Co, "B" represents boron or boron and carbon, a content of "R" is 28.0 to 32.0 mass % with respect to 100 mass % of a total mass of the R-T-B based sintered magnet, a content of Cu is 0.04 to 0.50 mass % with respect to 100 mass % of a total mass of the R-T-B based sintered magnet, a content of Mn is 0.02 to 0.10 mass % with respect to 100 mass % of a total mass of the R-T-B based sintered magnet, a content of Al is 0.15 to 0.30 mass % with respect to 100 mass % of a total mass of the R-T-B based sintered magnet, a content of Co is 0.50 to 3.0 mass % with respect to 100 mass % of a total mass of the R-T-B based sintered magnet, a content of "B" is 0.85 to 1.0 mass % with respect to 100 mass % of a total mass of the R-T-B based sintered magnet, and Tb2/Tb1 is 0.49 or more and 0.80 or less, where Tb1 (mass %) denotes an average content of Tb at a surface portion of the R-T-B based sintered magnet, and Tb2 (mass %) denotes an average content of Tb at a core portion of the R-T-B based sintered magnet, and the R-T-B based sintered magnet includes a plurality of main phase grains and grain boundaries, Tb is diffused at least into the core portion of the R-T-B based sintered magnet, and Tb is present in a shell of a main phase grain being a core-shell grain, the shell being defined as the part at which a molar ratio of the heavy rare earth element to the light rare earth element is two times or more the molar ratio at a core of the main phase grain being a core-shell grain.

2. The R-T-B based sintered magnet according to claim 1, wherein "R" consists of heavy rare earth elements and at least one light rare earth element, and the heavy rare earth elements consist of substantially only Dy and Tb.

3. The R-T-B based sintered magnet according to claim 1, wherein "R" consists of a heavy rare earth element and at least one light rare earth element, and the heavy rare earth element consists of substantially only Tb.

4. The R-T-B based sintered magnet according to claim 1, wherein "T" further comprises Ga and a content of Ga is 0.08 to 0.30 mass % with respect to 100 mass % of a total mass of the R-T-B based sintered magnet.

5. The R-T-B based sintered magnet according to claim 1, wherein

"T" further comprises Zr and a content of Zr is 0.10 to 0.25 mass % with respect to 100 mass % of a total mass of the R-T-B based sintered magnet.

6. The R-T-B based sintered magnet according to claim 1, wherein

"T" further comprises Ga and Zr, a content of Ga is 0.08 to 0.30 mass % with respect to 100 mass % of a total mass of the R-T-B based sintered magnet, and a content of Zr is 0.10 to 0.25 mass % with respect to 100 mass % of a total mass of the R-T-B based sintered magnet.

7. The R-T-B based sintered magnet according to claim 1, wherein Ga/Al is 1.30 or less by mass ratio.

8. The R-T-B based sintered magnet according to claim 1, wherein the content of "R" is 29.0 to 31.5 mass %.

9. The R-T-B based sintered magnet according to claim 1, wherein the content of Co is 1.0 to 2.5 mass %.

10. The R-T-B based sintered magnet according to claim 1, wherein the content of Cu is 0.10 to 0.50 mass %.

11. The R-T-B based sintered magnet according to claim 1, wherein the content of Al is 0.18 to 0.30 mass %.

12. The R-T-B based sintered magnet according to claim 1, wherein the content of Mn is 0.02 to 0.06 mass %.

13. The R-T-B based sintered magnet according to claim 1, wherein the content of "B" is 0.90 to 1.0 mass %.

* * * * *